US008177218B2

(12) United States Patent
Fuda

(10) Patent No.: US 8,177,218 B2
(45) Date of Patent: May 15, 2012

(54) SHEET FEEDING DEVICE AND IMAGE FORMING APPARATUS

(75) Inventor: Munehisa Fuda, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/926,659

(22) Filed: Dec. 2, 2010

(65) Prior Publication Data

US 2011/0148027 A1 Jun. 23, 2011

(30) Foreign Application Priority Data

Dec. 22, 2009 (JP) ..... 2009-290811

(51) Int. Cl.
*B65H 3/14* (2006.01)

(52) U.S. Cl. ..... 271/97; 271/98

(58) Field of Classification Search ..... 271/97, 271/98

See application file for complete search history.

(56) References Cited

U.S. PATENT DOCUMENTS

| | | | | |
|---|---|---|---|---|
| 3,253,825 | A * | 5/1966 | Buchwald | 271/97 |
| 7,380,781 | B2 * | 6/2008 | Ikeda | 271/98 |
| 7,708,264 | B2 * | 5/2010 | Kosugi et al. | 271/97 |
| 2007/0194514 | A1 * | 8/2007 | Ikeda | 271/97 |
| 2007/0228639 | A1 * | 10/2007 | Matsumoto et al. | 271/97 |
| 2009/0121411 | A1 * | 5/2009 | Kosugi et al. | 271/97 |

FOREIGN PATENT DOCUMENTS

| | | | |
|---|---|---|---|
| JP | 2934442 | B2 | 5/1999 |
| JP | 2000-103535 | A | 4/2000 |
| JP | 2000-177870 | A | 6/2000 |
| JP | 3559437 | B2 | 5/2004 |
| JP | 2004-224505 | A | 8/2004 |
| JP | 2006-016159 | A | 1/2006 |
| JP | 3959629 | B2 | 5/2007 |
| JP | 2008-308303 | A | 12/2008 |
| JP | 2009-190840 | A | 8/2009 |
| JP | 2009-203072 | A | 9/2009 |
| JP | 2010-089955 | A | 4/2010 |
| JP | 4495637 | B2 | 4/2010 |
| JP | 4516504 | B2 | 5/2010 |
| JP | 2007-331905 | A | 12/2010 |

OTHER PUBLICATIONS

Abstract of JP 11-184171 published Jul. 9, 1999.
Abstract of JP 2007-045630 published Feb. 22, 2007.
Abstract of JP 2004-075201 published Mar. 11, 2004.
Abstract of JP 2006-327778 published Apr. 16, 2010.
Abstract of JP 02-081838 published Mar. 22, 1990.

* cited by examiner

*Primary Examiner* — David H Bollinger
(74) *Attorney, Agent, or Firm* — Harness, Dickey & Pierce, P.L.C.

(57) ABSTRACT

A sheet feeding device includes a loading tray configured to receive a plurality of sheets thereon; a sheet transporting unit which transports the uppermost sheet among the sheets to an image forming unit; a blowing unit which blows air to one end portions of the sheets to lift the end portion of the uppermost sheet to separate the sheets from each other; a rear end regulating member which is disposed behind the rear ends of the sheets; and side end regulating members which are disposed next to both side ends of the sheets. A portion of the side end regulating members at which the side end regulating members come in contact with the sheet is provided with an emission portion allowing air to be emitted from the blowing unit.

4 Claims, 10 Drawing Sheets

SHEET FEEDING DEVICE AND IMAGE FORMING APPARATUS

CROSS-REFERENCE TO RELATED APPLICATIONS

The present application claims priority to and incorporates by reference the entire contents of Japanese Patent Application No. 2009-290811 filed in Japan on Dec. 22, 2009.

BACKGROUND OF THE INVENTION

1. Field of the Invention

The present invention relates to a sheet feeding device and an image forming apparatus, and particularly, to a sheet feeding device that lifts an end portion of an uppermost sheet among a plurality of sheets loaded in a loading tray using a blowing unit and transports the sheet to an image forming unit, and an image forming apparatus with the sheet feeding device.

2. Description of the Related Art

Japanese Patent Application Laid-open No. 2007-045630 discloses a sheet feeding device that rapidly feeds sheets one by one to an image forming unit of an image forming apparatus. The sheet feeding device separates the uppermost sheet of a sheet bundle using air from a blowing unit and transports the sheet. The basic configuration of the sheet feeding device is as follows. FIG. 7 is a cross-sectional view illustrating a configuration of a general sheet feeding device. In a sheet feeding device 20, a wind is blown from a blowing unit 1 such as a blower toward the front end portions and the side end portions of the plurality of sheets loaded in a sheet feeding tray 21, air is sent between the sheets by the blowing wind so that the sheet is lifted up to the height of a belt 2*a* of a suction belt unit 2, and then the uppermost sheet is sucked to and transported by the belt. Subsequently, the sheet is transported to the image forming unit by the suction belt unit 2, and an image is formed on the sheet.

Here, the blowing unit 1 serves to not only lift the sheet up to a predetermined height by sending air between the sheets, but also separate the sheets by blowing a wind toward an area extending in the vertical direction by a predetermined amount. A sheet blocking member 7 is disposed between the blowing unit 1 and the sheets, and prevents the sheets other than the uppermost sheet P1 from being transported.

Further, in order to constantly maintain a distance h between the belt 2*a*, and the position of the uppermost surface of the sheets, number of which decreases as the sheets are fed, the sheet feeding device includes a detection unit 3 which comes into contact with the uppermost sheet and detects the height of the sheets. The detection unit 3 includes an arm portion 4 which is rotatable to bump against the uppermost sheet, and a sensor which detects the rotation of the arm portion 4, and detects the movement amount of the arm portion 4 rotating due to a decrease in the number of the sheets by a photo sensor or the like. Then, the distance h between the position of the uppermost surface of the sheets and the belt 2*a* is adjusted by moving up a bottom plate 6 using an elevation unit or the like on the basis of a signal from the detection unit 3.

Here, the sheets are evenly aligned at the front end thereof on the sheet feeding tray 21 in accordance with the size of the sheets. Further, as shown in FIG. 7, the attachment position of the arm portion 4 is set to the vicinity of the rear end of the sheet so as not to be easily influenced by the wind blowing from the blowing unit 1.

In addition, side fences 23 are provided next to both side ends of the sheets, and the side fences 23 guide the side ends of the sheets so that, when the uppermost sheet is fed, straight movement of the sheet is maintained. An end fence 10 is provided at the back of the rear ends of the sheets, and the end fence 10 prevents the sheets from being extruded backward by the blowing unit 1. The end fence 10 is configured to be movable in the forward/backward direction using a slide rail, a guide, or the like so as to be movable in accordance with the size of the stacked sheet. Further, the end fence 10 is fixed with the help of a gear or a screw.

A transportation roller 8 is disposed on the downstream of the suction belt unit 2, and transports the sheets arriving at the transportation roller 8. The transportation force of the transportation roller 8 is set to be larger than that of the suction belt unit 2. Further, a sheet feeding sensor 9 to detect the arrival of the sheet is provided on the downstream of the transportation roller 8.

The sheet feeding device 20 operates as follows. FIGS. 8 to 11 are cross-sectional views illustrating the sequence of the operation of the sheet feeding device. The blowing unit 1 is activated to blow air toward the end portions of the sheet when a sheet feeding command is sent from the image forming apparatus body, as shown in FIG. 8. Then, at the same time, the air suction of the suction belt unit 2 starts. Thus, the uppermost sheet P1 is lifted and the uppermost sheet P1 is sucked to the belt 2*a* of the suction belt unit 2 as shown in FIG. 8.

Subsequently, the driving of the suction belt unit 2 and the transportation roller 8 starts as shown in FIG. 9, and the driving of the suction belt unit 2 stops after the sheet P1 arrives at the sheet feeding sensor 9 as shown in FIG. 10. Then, the transportation roller 8 continues to transport the sheet P1 while the belt 2*a* of the suction belt unit 2 stops.

Subsequently, as shown in FIG. 11, the sheet P2 is lifted by air and sucked directly after the sheet P1 exits from the suction area. Then, in accordance with the feeding interval which has been set, the driving of the suction belt unit 2 is resumed, and the feeding of the sheet P2 is performed. By repeating the above-described operations, the sheets are sequentially transported.

Here, in the sheet feeding device that separates the sheets with air to transport the sheets, when separating the sheets that adhere to each other with high adhesion force, it is general that the wind speed of the air from the blowing unit 1 is increased or the nozzle opening of the blowing unit 1 is enlarged to increase the volume of the wind blowing to the sheets so that the adhesion of the sheets is eliminated. However, in the case of feeding thin and highly adhesive sheets such as thin coated sheets, if the volume of the wind is increased as described above, a volume of air, which is larger than necessary to lift the sheet, is sent between the sheets.

As a result, a flaw may arise in the above-described sheet feeding device of the related art. FIG. 12 is a plane view illustrating the flaw of the sheet feeding device of the related art, and FIG. 13 is a cross-sectional view illustrating the flaw of the sheet feeding device of the related art.

That is, in the sheet feeding device of the related art, since the end portions of the sheets are in an area that is almost closed by the sheet blocking member 7, the side fences 23, and the end fence 10; the excessive air blowing between the sheets is blocked by the side fences 23 and the end fence 10 as shown in FIG. 12 and all of the air cannot exit from the end portions of the sheets, so that the remaining air accumulates between the sheets. When the air accumulates between the sheets in this way, the sheets are lifted upward in a bundle due to the accumulating air as shown in FIG. 13. Then, the sheet bundle is strongly pressed to the suction belt unit 2. In this state, when the driving of the suction belt unit 2 starts to feed the sheets, the sheets are fed in a bundle, which causes a double feeding. This causes waste of sheets and/or an undesirable event in which white sheets are mixed with printed sheets. As a result, the quality of the image forming apparatus is prominently degraded.

SUMMARY OF THE INVENTION

It is an object of the present invention to at least partially solve the problems in the conventional technology.

According to an aspect of the present invention there is provided a sheet feeding device including: a loading tray configured to receive a plurality of sheets thereon; a sheet transporting unit which transports the uppermost sheet among the sheets loaded on the loading tray to an image forming unit; a blowing unit which is disposed adjacent to the uppermost sheet among the sheets loaded on the loading tray and blows air to one end portions of the sheets to lift the end portions of the uppermost sheet and the sheets near the uppermost sheet to separate the sheets from each other; a rear end regulating member which is disposed behind the rear ends of the sheets and regulates positions of the rear ends of the sheets; and side end regulating members which are disposed next to both side ends of the sheets and regulate positions of the side ends of the sheets. A portion of the side end regulating members at which the side end regulating member comes in contact with the sheet is provided with an emission portion allowing air to be emitted from the blowing unit.

According to another aspect of the present invention there is provided an image forming apparatus including the sheet feeding device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A sheet feeding device according to an embodiment includes a loading tray configured to receive a plurality of sheets thereon, a blowing unit that is disposed adjacent to an uppermost sheet among the plurality of sheets loaded on the loading tray and blows air to one end portions of the sheets to lift the end portions of the uppermost sheet and the sheets near the uppermost sheet and separate the plurality of sheets from each other, a rear end regulating member disposed behind rear ends of the sheets to regulate positions of the rear ends of the sheets, and side end regulating members disposed next to both side ends of the sheets to regulate the positions of the side ends of the sheets. A portion of the side end regulating members at which the side end regulating members come in contact with the sheets is provided with an emission portion that allows air to be emitted from the blowing unit therethrough.

According to the embodiment, since the emission portion is provided in the side end regulating member at the portion that contacts the sheets, even when the volume of the air from the blowing unit becomes large, surplus air is emitted from the emission portion, thereby preventing air from filling between the sheets. For this reason, even when a large volume of air is blown in order to feed thin sheets (for example, thin coated sheets) that adhere to each other with high adhesion force, an excessive volume of air does not fill between the sheets, thereby eliminating the adhesion state without lifting the sheets in a bundle and preventing a double feeding. Further, since the area contacting the feeding sheet becomes small, the contact resistance is reduced during the feeding operation, which prevents a non-feeding of the sheet and a damage of the feeding sheet.

In the sheet feeding device of the embodiment, a sheet transporting unit may include a sheet suction portion at which the sheet is sucked on a suction belt and a suction unit that makes the uppermost sheet among the plurality of sheets loaded on the loading tray be sucked to the sheet suction portion of the sheet transporting unit by air suction.

The sheet feeding device of the embodiment may further include a sheet blocking member disposed between the blowing units and the sheets loaded on the loading tray so as to block the sheets other than the uppermost sheet.

In the sheet feeding device of the embodiment, the emission portion may be formed by a plurality of through-holes disposed at a predetermined interval and configured to penetrate the side end regulating member.

Further, an image forming apparatus of the embodiment may include the above-described sheet feeding device. According to the sheet feeding device of the embodiment, a thin sheets (for example, thin coated sheets) that adhere to each other with high adhesion force and are not easily fed by the sheet feeding device by means of air separation and suction can be reliably fed, so that the transportation quality improves.

Figure 1:
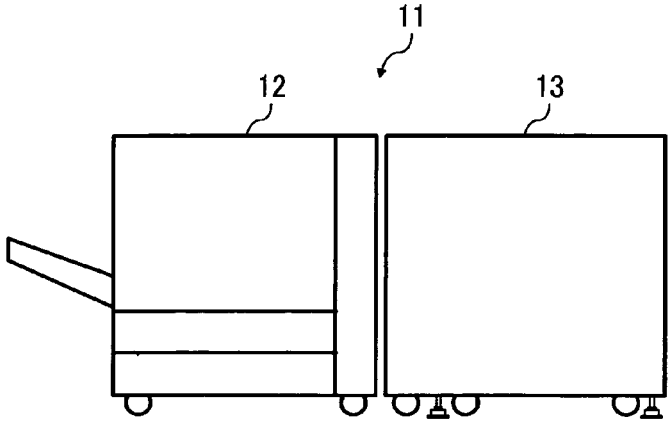
FIG. 1 is a side view illustrating a schematic configuration of an image forming apparatus of an embodiment.
Figure 2:
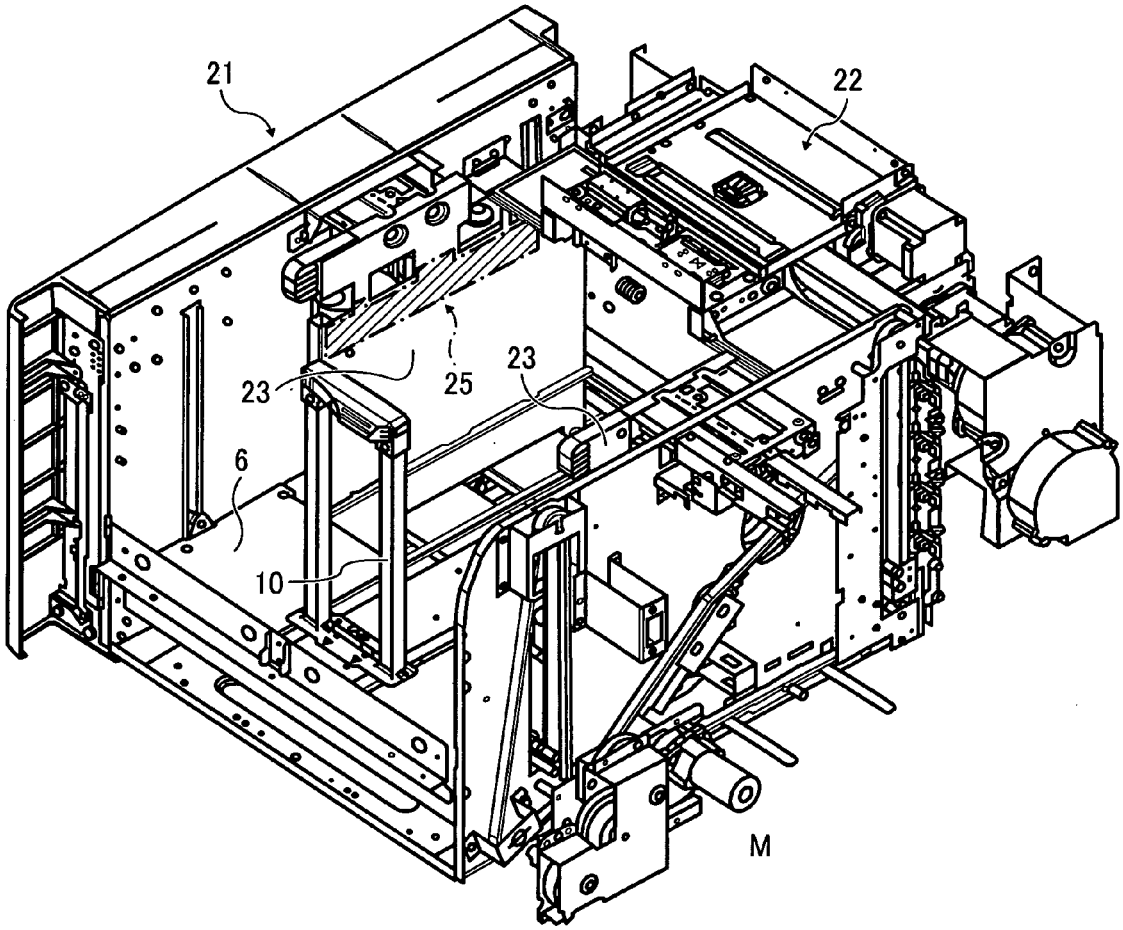
FIG. 2 is a perspective view illustrating an internal configuration of a sheet feeding device.
Figure 3:
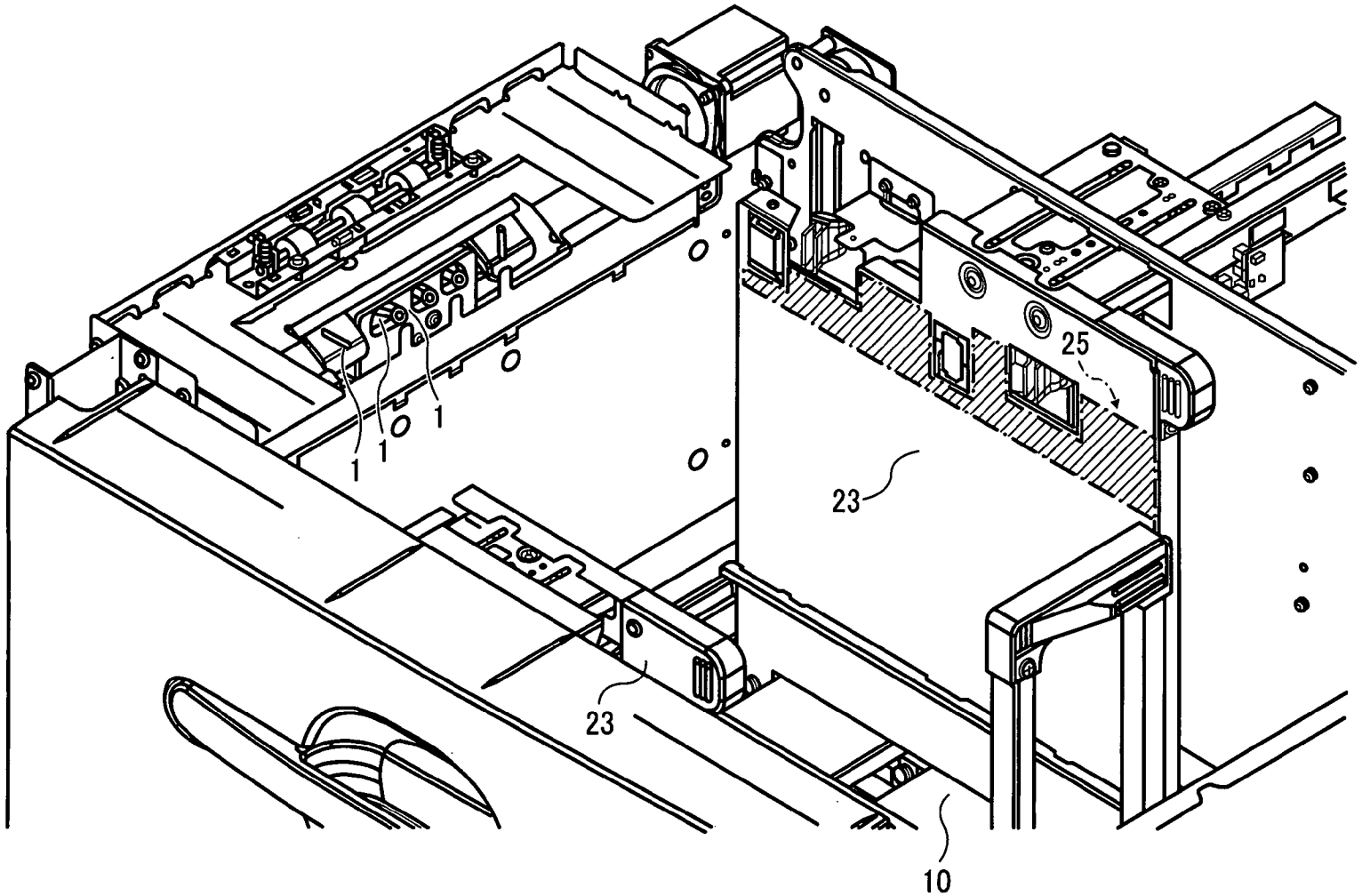
FIG. 3 is a perspective view illustrating the sheet feeding device from which a suction belt unit is removed.
Figure 4:
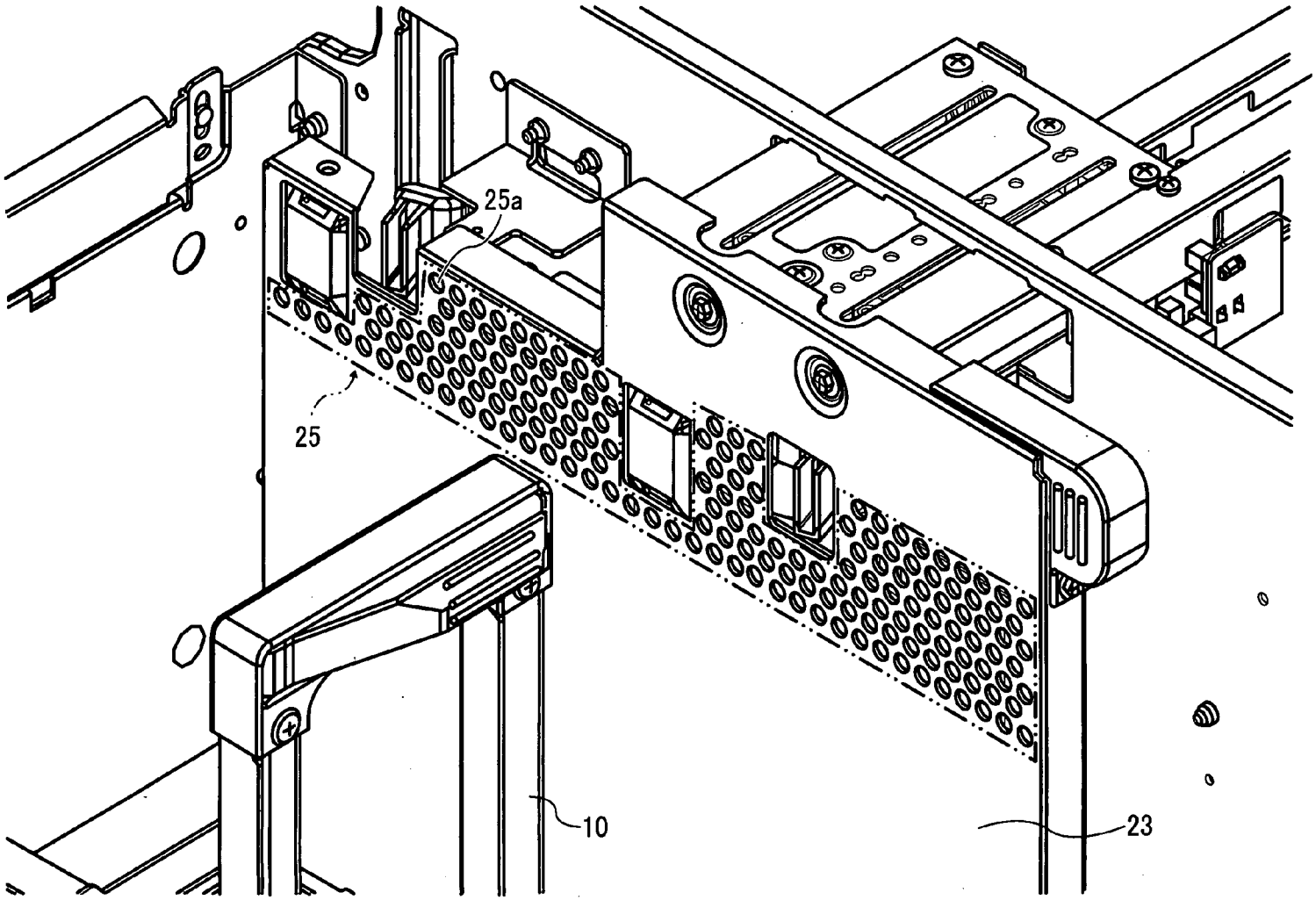
FIG. 4 is an enlarged perspective view illustrating the sheet feeding device.
Figure 5:
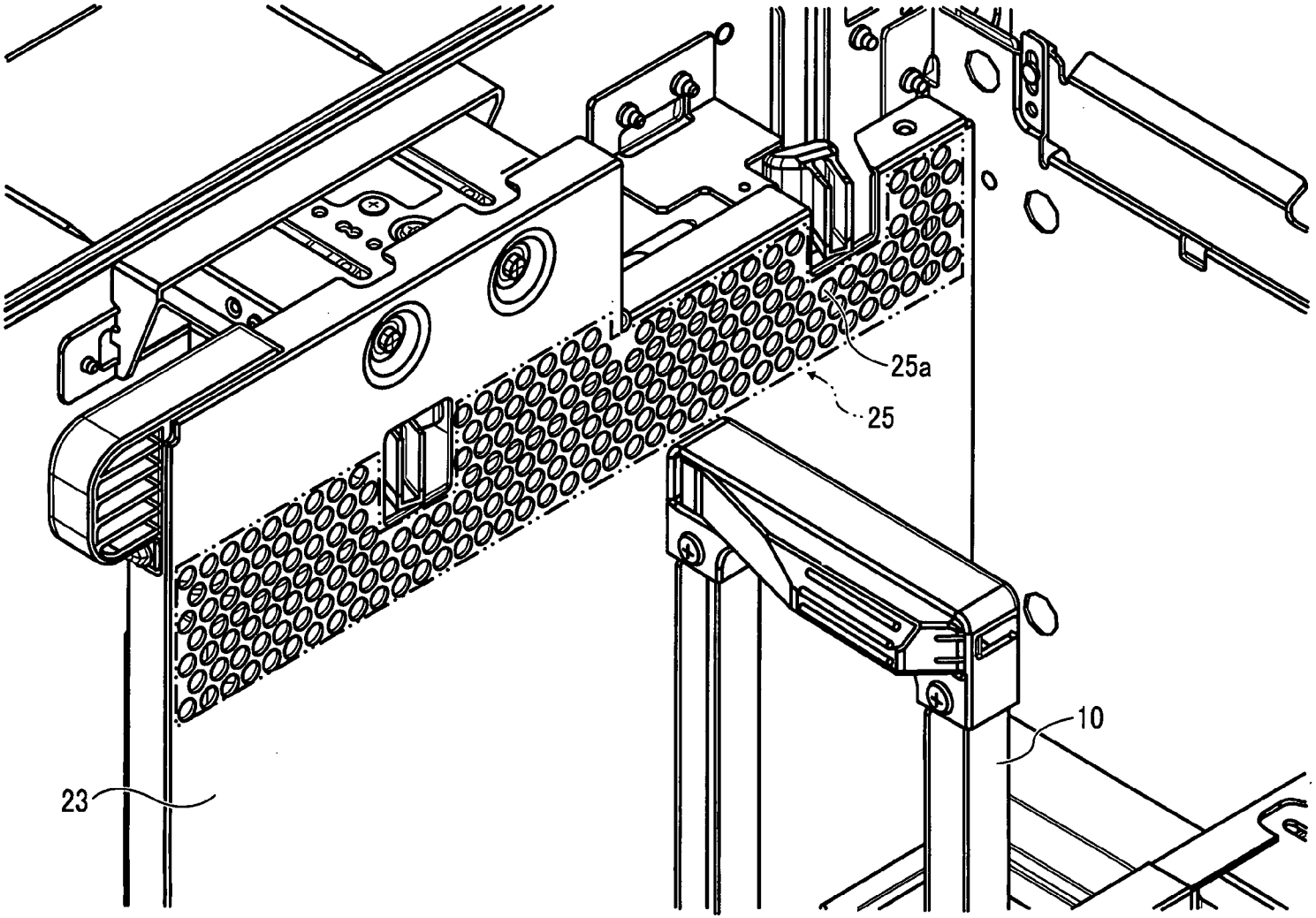
FIG. 5 is an enlarged perspective view illustrating the sheet feeding device when viewed from a different direction from that of FIG. 4.

Hereinafter, an image forming apparatus according to the embodiment of the invention will be described with reference to the drawings. FIG. 1 is a side view illustrating a schematic configuration of the image forming apparatus according to the embodiment. FIG. 2 is a perspective view illustrating an internal configuration of the sheet feeding device. FIG. 3 is a perspective view illustrating the sheet feeding device from which a suction belt unit is removed. FIG. 4 is an enlarged perspective view illustrating the sheet feeding device. FIG. 5 is an enlarged perspective view illustrating the sheet feeding device when viewed from a different direction from that of FIG. 4.

As shown in FIG. 1, an image forming apparatus 11 according to this embodiment includes an image forming apparatus body 12, and a sheet feeding device 13 that is connected to one side surface of the image forming apparatus body 12. The basic configuration of the sheet feeding device 13 according to the embodiment is the same as that of the sheet feeding device 20 described as an example of the related art. That is, as shown in FIG. 2, the sheet feeding device 13 includes the sheet feeding tray (loading tray) 21 which has the bottom plate 6 for allowing a bundle of sheets to be loaded thereon and the suction belt unit 22 which takes out one by one the uppermost sheet of the sheet bundle and feeds the sheet to the image forming apparatus body 12.

Figure 7:
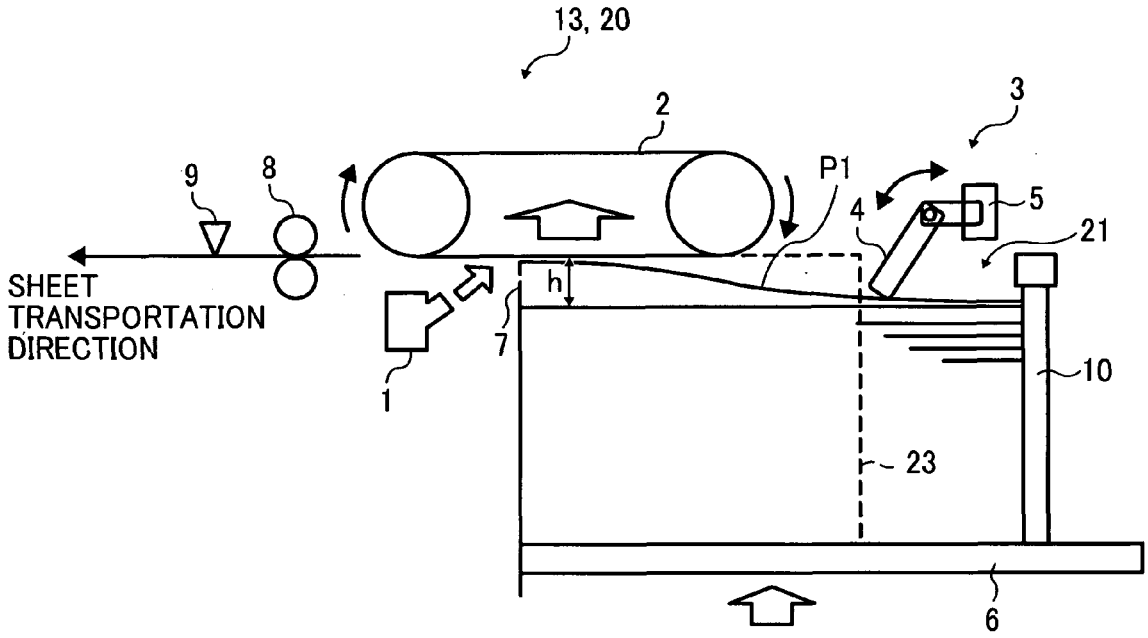
FIG. 7 is a cross-sectional view illustrating a configuration of a general sheet feeding device.

Further, in the sheet feeding tray 21, the side fences 23 are respectively provided on both sides so as to guide the side end of the sheet bundle loaded on the bottom plate 6 in the width direction (the direction perpendicular to the sheet feeding direction), and the end fence 10 is provided at the back of the sheet bundle so as to support the rear end of the sheet bundle. The sheet feeding device 13 according to the embodiment has the same general configuration as that of the sheet feeding device 20 and includes the sheet blocking member 7, the detection unit 3, the transportation roller 8, and the sheet feeding sensor 9 (see FIG. 7).

Further, as shown in FIGS. 2 to 5, the sheet feeding device 13 according to the embodiment includes the blowing unit 1 that is provided to lift the sheets and separate the sheets from each other directly below the suction belt unit. As shown in FIGS. 4 and 5, the sheet feeding device 13 has a plurality of circular through-holes 25*a* that are formed in series at a predetermined interval and serve as the emission portion, where the through-holes 25*a* are formed at a contact area 25 of the side fence 23, which is a portion at which the side fence 23 comes in contact with the sheet. Further, in the embodiment, although the plurality of through-holes 25*a* are provided as the emission portion, a plurality of penetrating slits or the like may be adopted as the emission portion.

Figure 6:
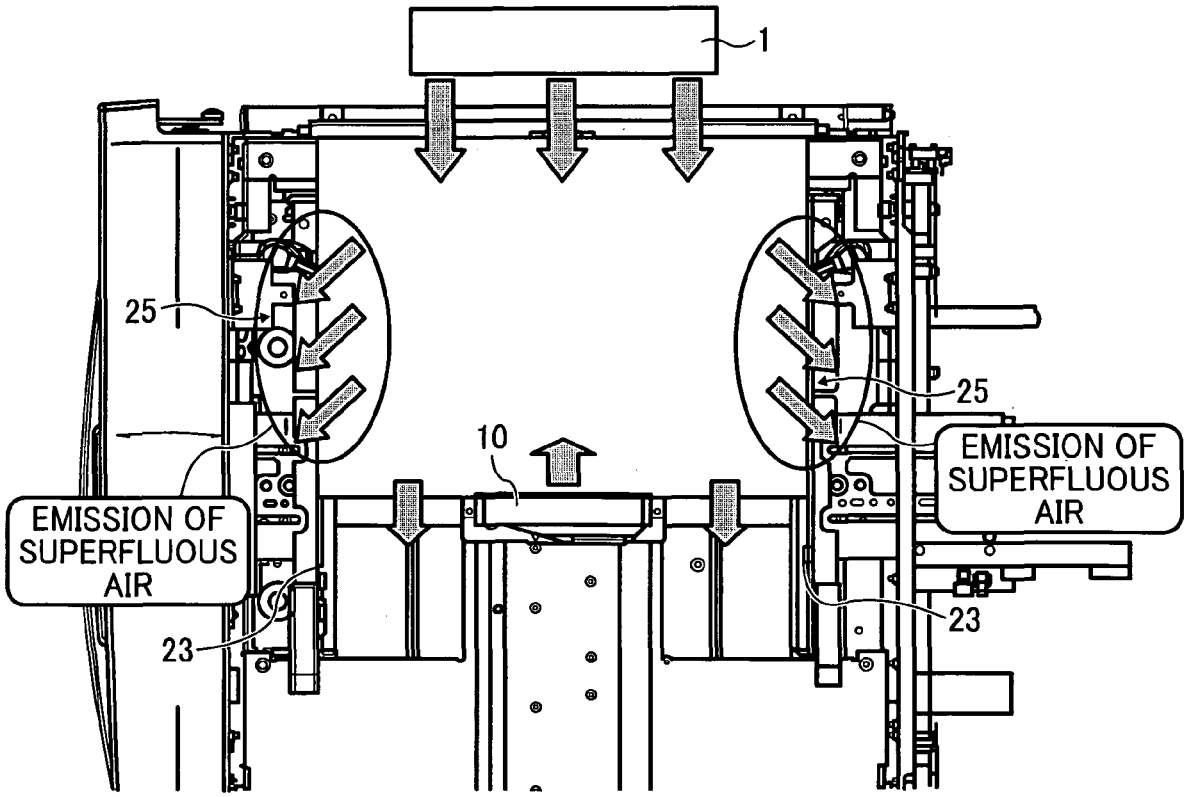
FIG. 6 is a plan view illustrating an operation of the sheet feeding device according to the embodiment.
Figure 8:
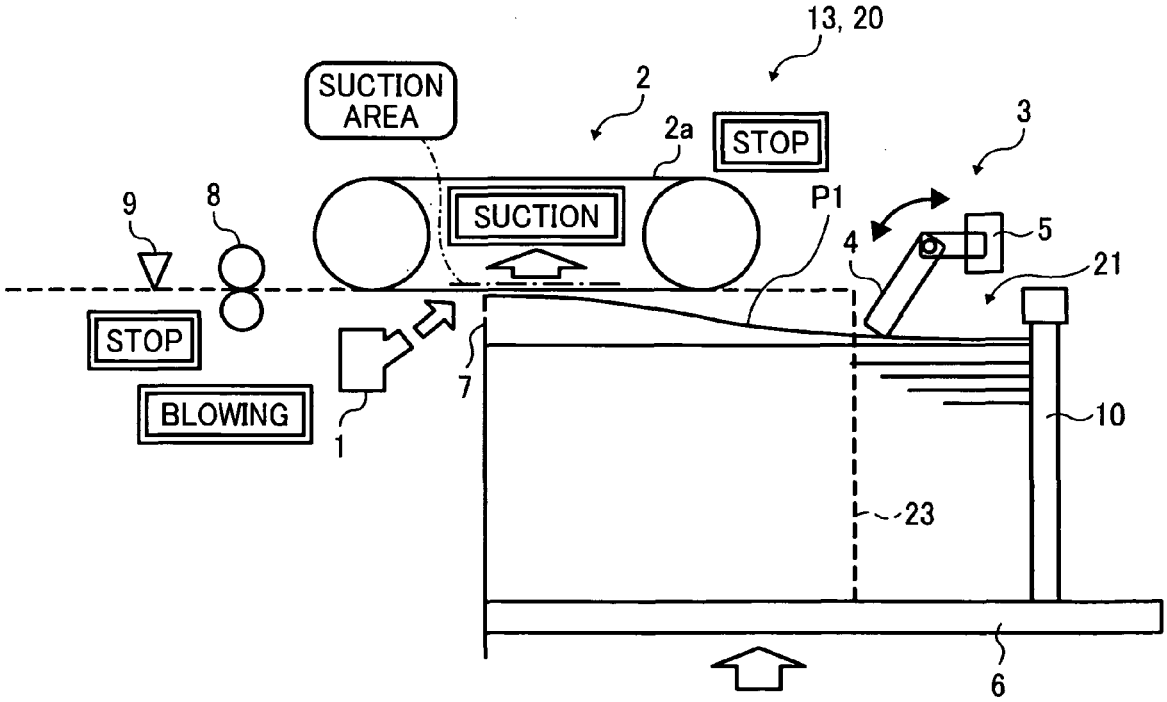
FIG. 8 is a cross-sectional view illustrating an operation of the sheet feeding device.

With the above-described configuration, the sheet feeding device 13 according the embodiment operates as below. FIG. 6 is a plan view illustrating an operation of the sheet feeding device according to the exemplary embodiment. First, when a sheet feeding command is sent from the image forming apparatus body, the blowing unit 1 is activated to blow air toward the end portions of the sheets. At the same time, the air suction of the suction belt unit 2 starts. Accordingly, the uppermost sheet P1 is lifted, and the uppermost sheet P1 is sucked to a belt 2*a* of the suction belt unit 2 (see FIG. 8).

For this instance, the volume of air from the blowing unit 1 is increased when separating the sheets that adhere to each other with high adhesion force. The selection of the volume of air may be automatically performed or manually performed by an operator. According to the exemplary embodiment, when the volume of air supplied from the blowing unit 1 is increased, surplus air is emitted from the plurality of 1 through-holes 25*a* as shown in FIG. 6. For this reason, air does not accumulate between the sheets, thereby preventing a phenomenon that the sheets are lifted upward in a bundle.

Figure 9:
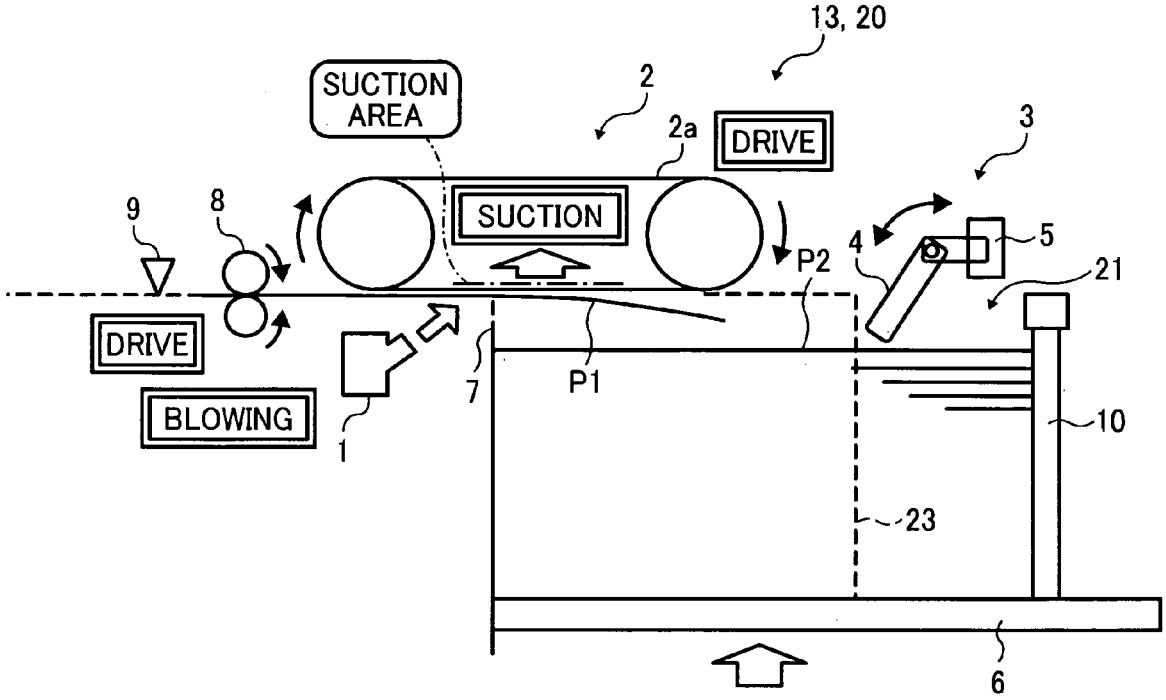
FIG. 9 is a cross-sectional view illustrating an operation of the sheet feeding device.
Figure 10:
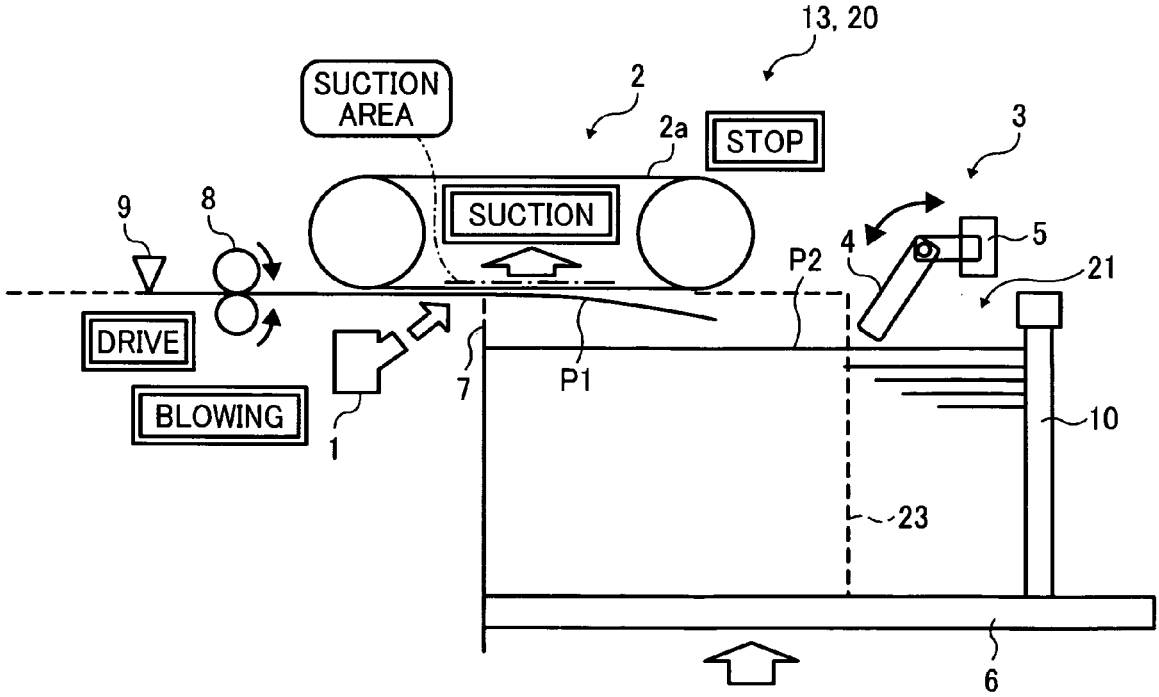
FIG. 10 is a cross-sectional view illustrating an operation of the sheet feeding device.

Subsequently, the driving of the suction belt unit 2 and the transportation roller 8 starts, and the sheet P1 is transported (see FIG. 9). After the sheet P1 arrives at the sheet feeding sensor 9, the driving of the suction belt unit 2 stops. Subsequently, the transportation roller 8 continues to transport the sheet P1 while the belt 2*a* of the suction belt unit 2 stops (see FIG. 10).

Figure 11:
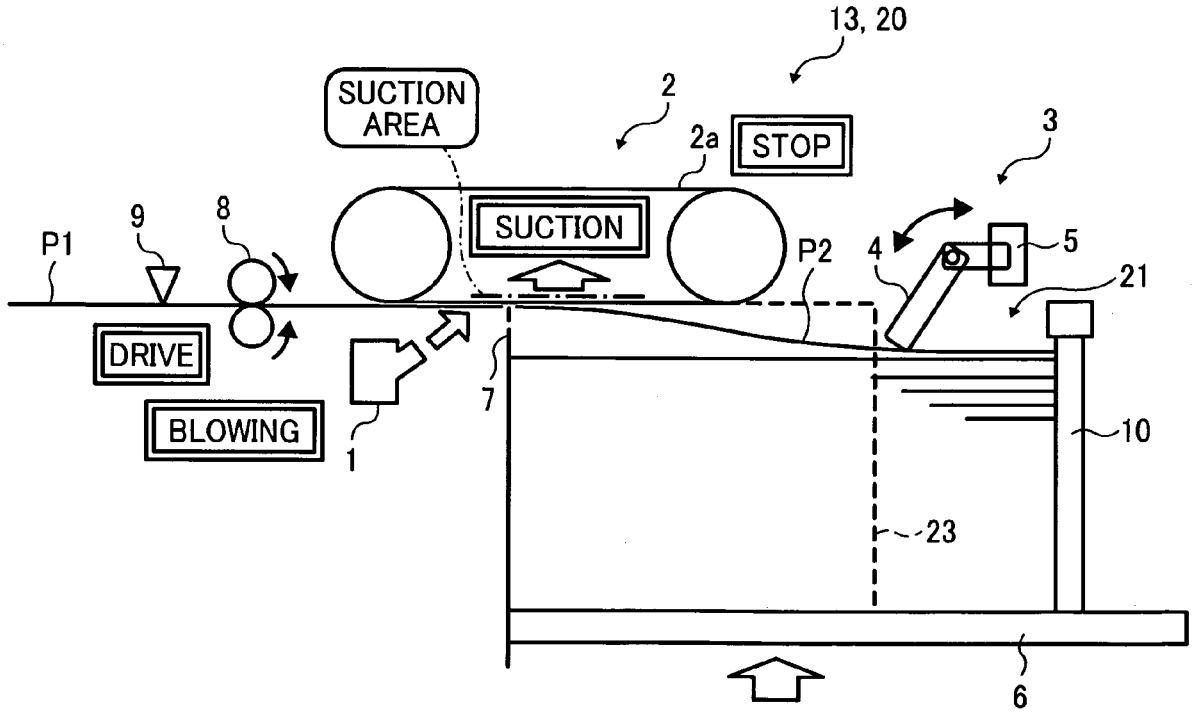
FIG. 11 is a cross-sectional view illustrating an operation of the sheet feeding device.
Figure 12:
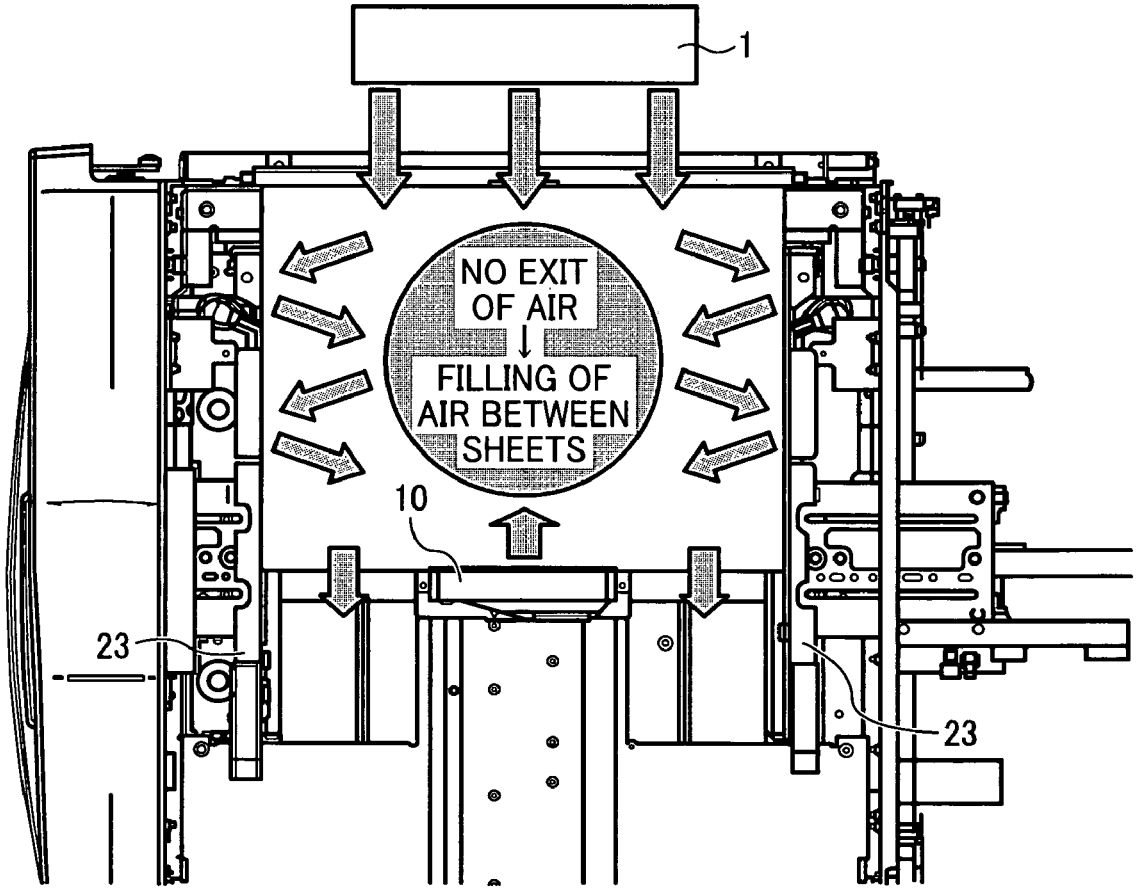
FIG. 12 is a plan view illustrating the flaw of the sheet feeding device of the related art.
Figure 13:
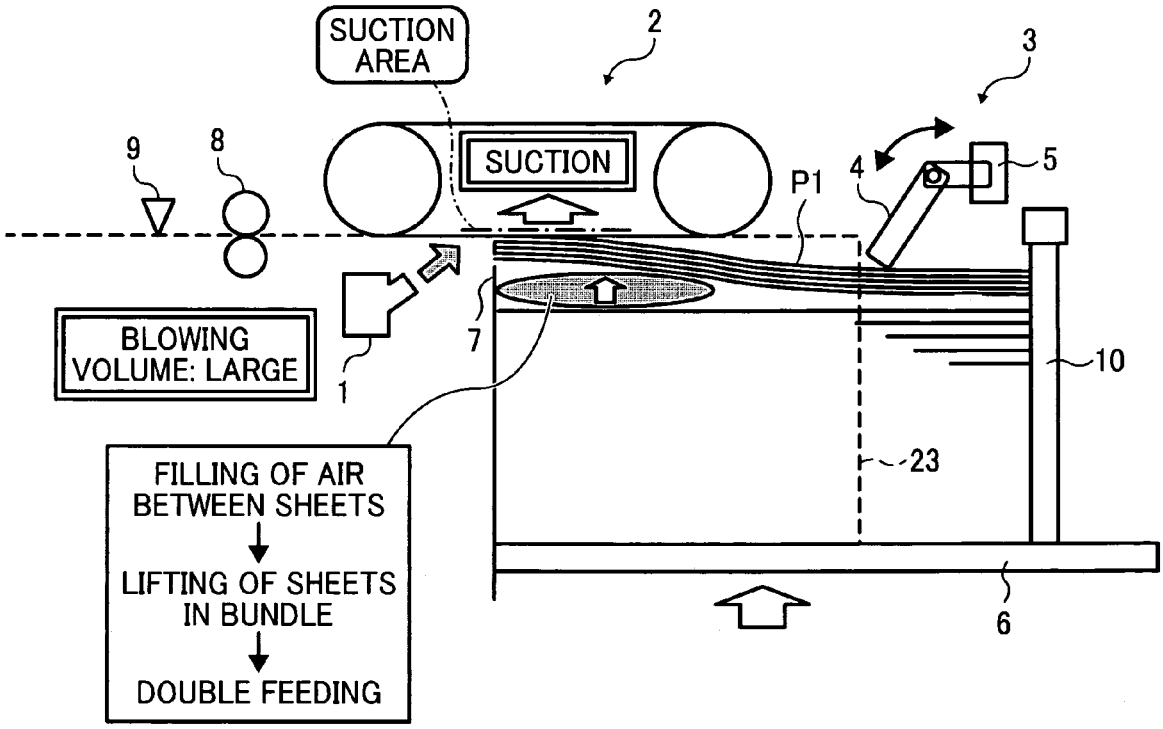
FIG. 13 is a cross-sectional view illustrating the flaw of the sheet feeding device of the related art.

Then, the sheet P2 is lifted and sucked to the belt by air right after the sheet P1 exits from the suction area. Subsequently, according to the feeding interval which has been set, the driving of the suction belt unit 2 is resumed, and the feeding of the sheet P2 is performed. By repetition of the above-described operations, the sheets are sequentially transported (see FIG. 11).

Therefore, in the sheet feeding device according to the embodiment, even if a large volume of air blows upon feeding a sheet such as a thin coated sheets that adhere to each other with high adhesion force, air does not excessively accumulate between the sheets. Therefore, the adhesion between the sheets can be eliminated so that the sheets are not lifted in a bundle. This prevents a double feeding of the sheets.

According to the embodiment, since an area, with which the feeding sheet comes in contact, is not continuous but intermittent, the contact resistance during the feeding operation of the sheet is reduced, thereby preventing a non-feeding of the sheet and a damage to the sheet.

Further, in the image forming apparatus 11 including the sheet feeding device 13 according to the embodiment, thin sheets that adhere to each other with high adhesion force and are not easily fed by the sheet feeding device using air separation and suction can be reliably fed and the quality of the apparatus improves.

According to the sheet feeding device of the embodiment, since the emission portion is provided at the portion of the side end regulating member at which the side end regulating member comes in contact with the sheet, even when the volume of the air from the blowing unit becomes large, surplus air is emitted from the emission portion. Therefore, surplus air does not accumulate between the sheets. Also, even when thin sheets that adhere to each other with high adhesion force are fed, an excessive volume of air is not filled between the sheets, and the adhesion state of the sheets can be eliminated without lifting the sheets in a bundle, thereby preventing a double feeding.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a loading tray configured to receive a plurality of sheets thereon;

a sheet transporting unit which transports the uppermost sheet among the sheets loaded on the loading tray to an image forming unit;

a blowing unit which is disposed adjacent to the uppermost sheet among the sheets loaded on the loading tray and blows air to one end portions of the sheets to lift the end portions of the uppermost sheet and the sheets near the uppermost sheet to separate the sheets from each other;

a rear end regulating member which is disposed behind the rear ends of the sheets and regulates positions of the rear ends of the sheets; and side end regulating members which are disposed next to both side ends of the sheets and regulate positions of the side ends of the sheets, wherein a portion of the side end regulating members at which the side end regulating member comes in contact with the sheet is provided with an emission portion allowing air to be emitted from the blowing unit and the emission portion is formed by a plurality of through-holes which is disposed at a predetermined interval and penetrates the side end regulating member.

2. The sheet feeding device of claim 1, wherein the sheet transporting unit comprises:

a sheet suction portion at which the sheet is sucked on a suction belt; and a suction unit that makes the uppermost sheet among the sheets loaded on the loading tray be sucked to the sheet suction portion of the sheet transporting unit by air suction.

3. The sheet feeding device of claim 1, further comprising:

a sheet blocking member disposed between the blowing unit and the sheets loaded on the loading tray so as to block the sheets other than the uppermost sheet.

4. An image forming apparatus comprising:

a sheet feeding device including, a loading tray configured to receive a plurality of sheets thereon;

a sheet transporting unit which transports the uppermost sheet among the sheets loaded on the loading tray to an image forming unit;

a blowing unit which is disposed adjacent to the uppermost sheet among the sheets loaded on the loading tray and blows air to one end portions of the sheets to lift the end portions of the uppermost sheet and the sheets near the uppermost sheet to separate the sheets from each other;

a rear end regulating member which is disposed behind the rear ends of the sheets and regulates positions of the rear ends of the sheets; and side end regulating members which are disposed next to both side ends of the sheets and regulate positions of the side ends of the sheets, wherein a portion of the side end regulating members at which the side end regulating member comes in contact with the sheet is provided with an emission portion allowing air to be emitted from the blowing unit and the emission portion is formed by a plurality of through-holes which is disposed at a predetermined interval and penetrates the side end regulating member.

* * * * *